US011000160B1

(12) United States Patent
Jackson

(10) Patent No.: US 11,000,160 B1
(45) Date of Patent: May 11, 2021

(54) BELOW TABLE SANITARY SYSTEM AND METHOD OF USE

(71) Applicant: Romell K. Jackson, Duncanville, TX (US)

(72) Inventor: Romell K. Jackson, Duncanville, TX (US)

( * ) Notice: Subject to any disclaimer, the term of this patent is extended or adjusted under 35 U.S.C. 154(b) by 0 days.

(21) Appl. No.: 16/352,370

(22) Filed: Mar. 13, 2019

Related U.S. Application Data

(63) Continuation of application No. 15/600,737, filed on May 21, 2017, now abandoned.

(60) Provisional application No. 62/339,244, filed on May 20, 2016.

(51) Int. Cl.
*A47K 5/12* (2006.01)
*B08B 3/04* (2006.01)
*A47K 5/06* (2006.01)

(52) U.S. Cl.
CPC ..... *A47K 5/12* (2013.01); *A47K 5/06* (2013.01); *A47K 5/1217* (2013.01); *A47K 2005/1218* (2013.01); *B08B 3/04* (2013.01)

(58) Field of Classification Search
CPC ..... A47K 5/12; A47K 5/06; A47K 5/1217; B08B 3/04
See application file for complete search history.

(56) References Cited

U.S. PATENT DOCUMENTS 3,533,526 A * 10/1970 Adell ..... B60S 1/50 215/399
2003/0160066 A1* 8/2003 Houvras ..... B65D 23/003 222/181.3
2011/0155766 A1* 6/2011 Hurley ..... A47K 5/12 222/180
2011/0259920 A1* 10/2011 Rennie ..... A47K 5/1205 222/165
2015/0083754 A1* 3/2015 Proper ..... B67D 3/0029 222/180
2015/0235549 A1* 8/2015 Limbert ..... E05B 35/002 340/573.1

* cited by examiner

*Primary Examiner* — Donnell A Long
(74) *Attorney, Agent, or Firm* — Richard Eldredge; Leavitt Eldredge Law Firm

(57) ABSTRACT

A combination of a fluid dispenser and a table includes the table having a top surface and a bottom surface; the fluid dispenser having a base with a base top surface and a base bottom surface, the base top surface to secure flat against the bottom surface of the table, the base further having a first rail extending at least a partial length of the first side and a second rail extending at least a partial length of the second side; a body forming an interior area, the body having a first lip and a second lip to slidingly engage with the first rail and the second rail, thereby securing the base and the body together; a pump in communication with the interior area; a button engaged with the pump; and an opening extending into the interior area.

7 Claims, 10 Drawing Sheets

BELOW TABLE SANITARY SYSTEM AND METHOD OF USE

BACKGROUND

1. Field of the Invention

The present application relates generally to sanitary systems, and more specifically, to sanitary system positioned below a table top, bar, counter or any bottom of a flat surface.

2. Description of Related Art

Hand sanitizer dispensers are well known in the art and are effective means to store and carry sanitizer liquid. For example, FIG. 1 depicts a side view of a dispenser 101 having a body 103 configured to store fluid therein and to rest on a surface 105 of a structure. The dispenser 101 is further provided with a pump 107 configured to dispense the liquid carried within body 103.

One of the problems associated with dispenser 101 is the limited use. For example, it is commonly known that a dinner table has little to no space due to the place settings and food placed thereon. There is generally no room for a dispenser nor is a dispenser generally desired on the table as the liquid carried therein could contaminate the food. However, it is desired to have a dispenser nearby to sanitize the hands prior to eating. Accordingly, there is a need for a better sanitary system that overcomes the problems associated with conventional hand sanitizer systems.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
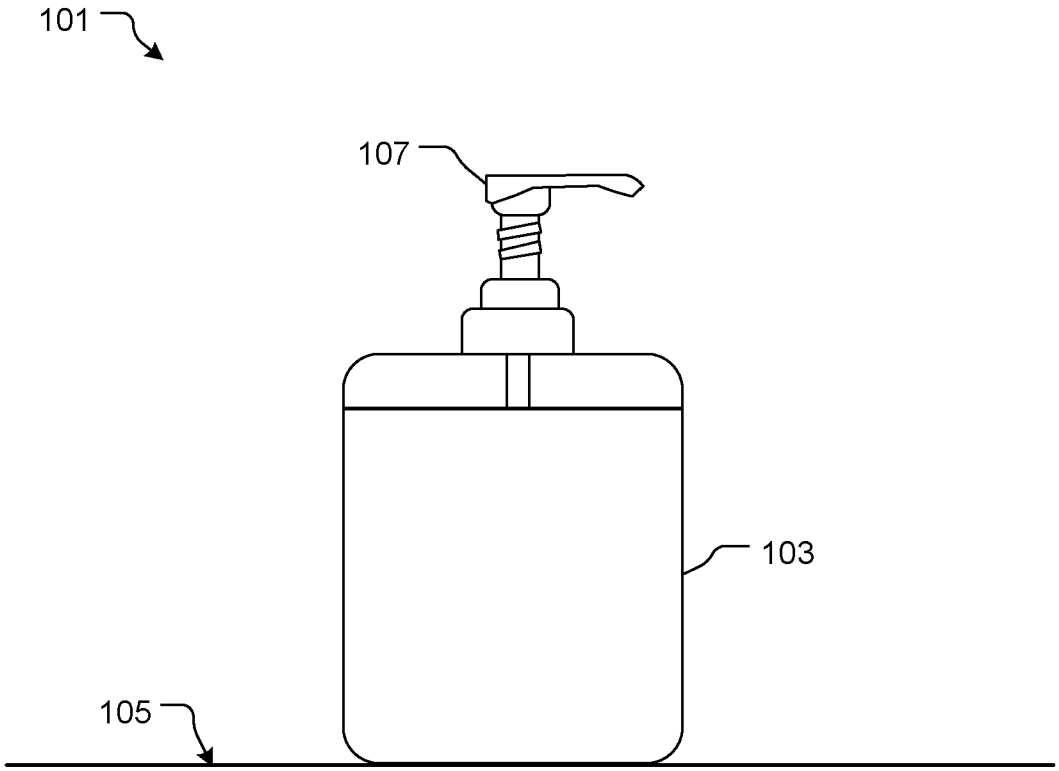
FIG. 1 (Prior Art)
FIG. 1 is a side view of a conventional hand sanitizer dispenser.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the system and method of use are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use of the present application will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 2:
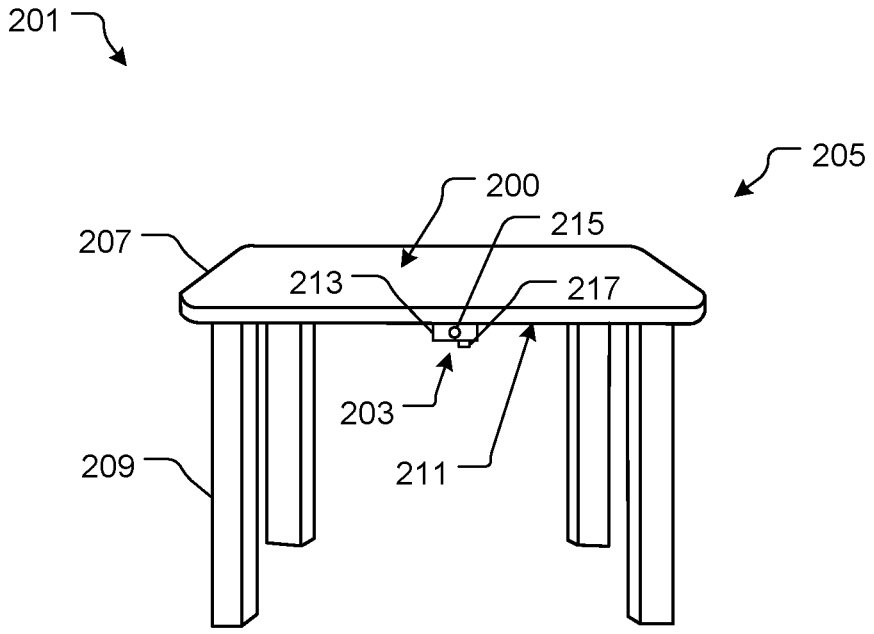
FIG. 2 is a front view of a sanitizer system in accordance with a preferred embodiment of the present application.
Figure 3:
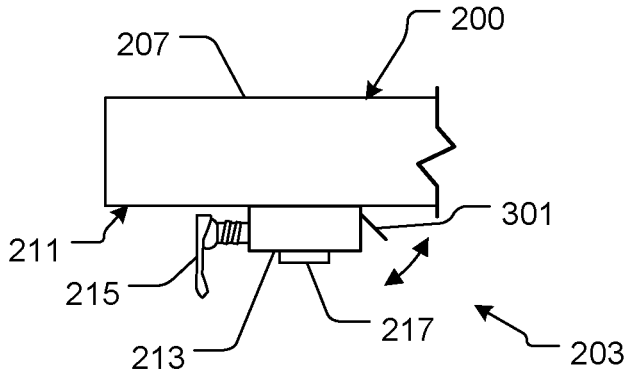
FIG. 3 is a partial side view of the system of FIG. 2.

Referring now to the drawings wherein like reference characters identify corresponding or similar elements throughout the several views, FIGS. 2 and 3 depict front and side views of a sanitizer system 201 in accordance with a preferred embodiment of the present application. It will be appreciated that system 201 overcomes one or more of the problems commonly associated with conventional sanitizer dispensers as discussed below and shown in the accompanying drawings.

System 201 includes one or more of a dispenser 203 and a table 205. In the preferred embodiment, the dispenser 203 is secured to a bottom surface 211 of table top 207, which in turn leaves the top surface 200 clear form obstruction. The table top 207 is elevated at a height relative to the ground surface via a plurality of legs 209, which in turn allows the user to access the dispenser 213 and to sit at table 205 via a chair (not shown).

The dispenser 203 is provided with a housing 213, a pump 215 secured to the housing 213, and an optional trigger 217 also secured to housing. In the preferred embodiment, the housing 213 has a hollow interior that configured to carry a cartridge of fluid therein and accessed via a pivoting door 301. The housing is preferably rigidly attached to surface 211 of the table top.

During use, the user presses against either pump 215 or trigger 217 for dispersing of fluid carried within the housing. The trigger 217 could be a button, lever, and/or other suitable means to manually eject the fluid from within the housing. The fluid travels from the inner cavity of the housing through the pump 215, which is also another contemplated means to eject the fluid. When refill is needed, the empty cartridge, bag, and/or other suitable storage apparatus is removed from within the housing via door 301 and replaced with a filled cartridge, bag, and/or other suitable means.

Figure 4:
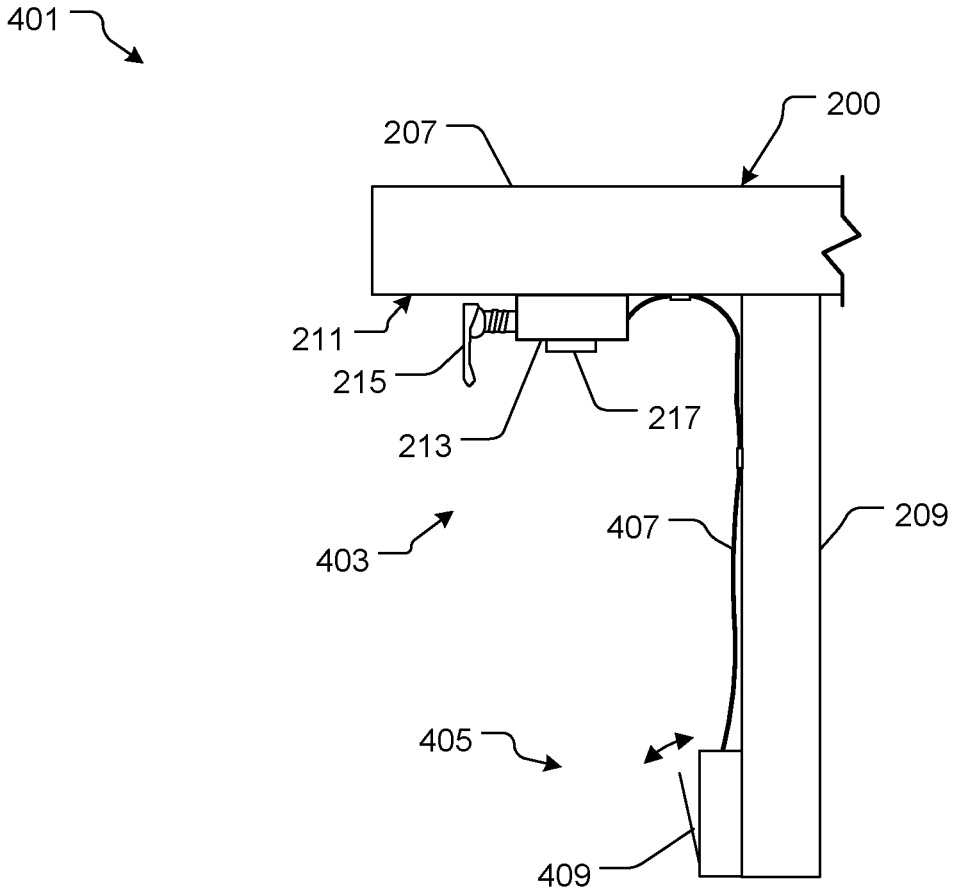
FIG. 4 is a partial side view of a system in accordance with an alternative embodiment of the present application.

Referring now to FIG. 4, a system 401 is shown in accordance with an alternative embodiment of the present application. It will be appreciated that system 401 hereby incorporates one or more of the features of system 201, and vice-versa. In this embodiment, the dispenser 403 is provided with a housing 405 in fluid communication with housing 213 and connected via a hose 407 secured to leg 209. During use, the fluid cartridge, bag, and/or other suitable storage apparatus is stored within the housing 405 and accessed via door 409. This embodiment provides effective means to carry the fluid in a location away from the dispenser housing 213, which in turn allows the dispenser to be less intrusive.

Figure 5:
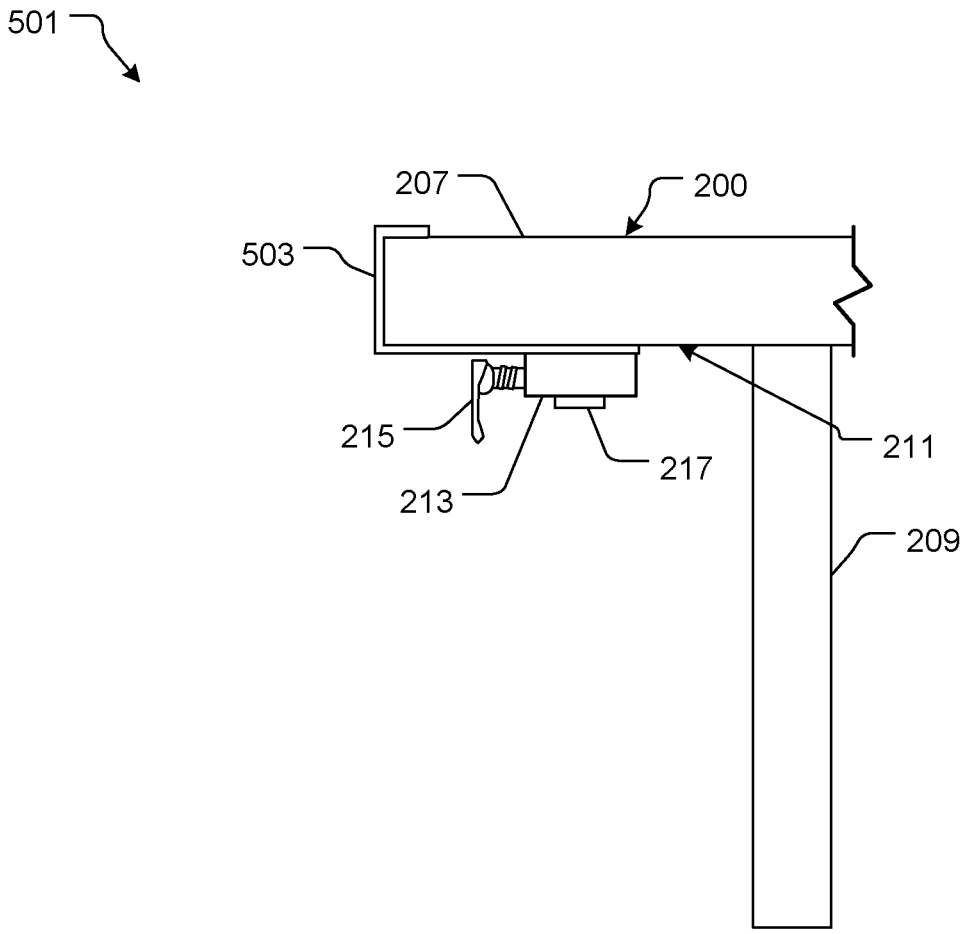
FIG. 5 is a partial side view of a system in accordance with an alternative embodiment of the present application.

Referring now to FIG. 5, a system 501 is shown in accordance with an alternative embodiment of the present application. It will be appreciated that system 501 hereby incorporates one or more of the features of systems 201, 401, and vice-versa. In this embodiment, the system 501 is provided with a bracket 503 secured to housing 213 and configured to engage with surfaces 211 and 200 of the table top. Accordingly, this embodiment provides rapid and effective means to remove the dispenser from the table and/or retrofit existing tables with the system.

Figure 6:
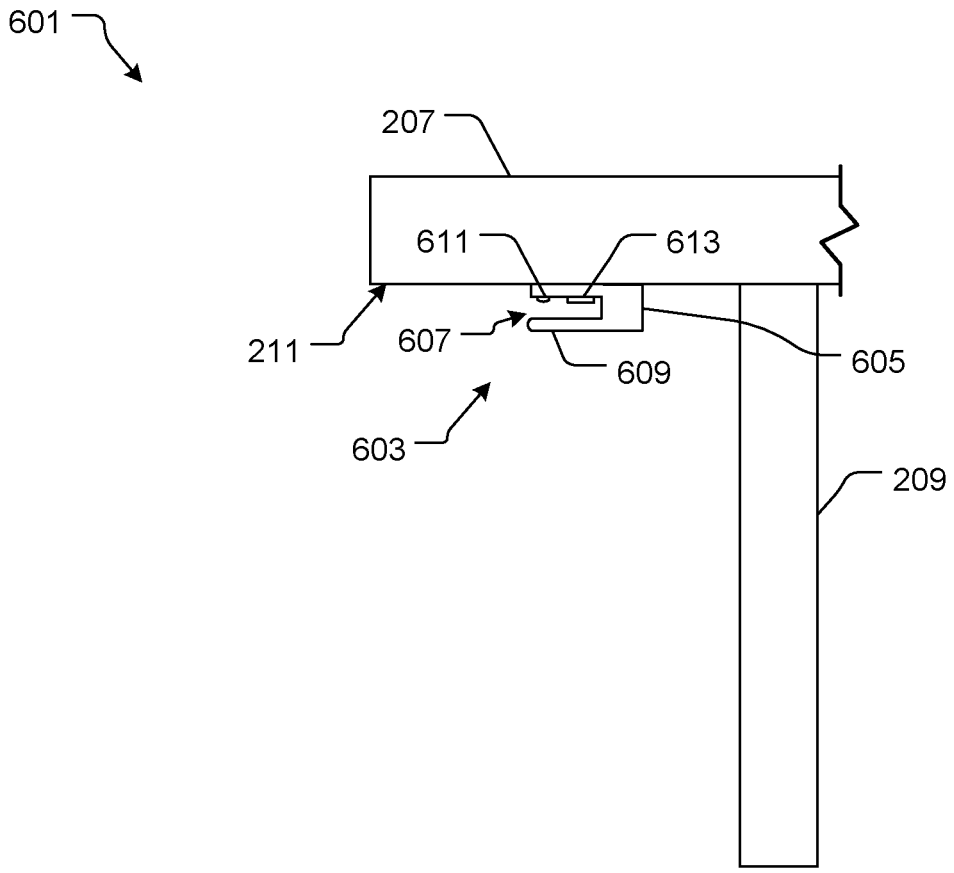
FIG. 6 is a partial side view of a system in accordance with an alternative embodiment of the present application.

Referring now to FIG. 6, a system 601 is shown in accordance with an alternative embodiment of the present application. It will be appreciated that system 601 hereby incorporates one or more of the features of systems 201, 401, 501 and vice-versa. In this embodiment, the system 601 is provided with a dispenser 603 that autonomously dispenses the sanitizer liquid. To achieve this feature, dispenser 603 includes a housing 605 that carries the fluid therein and forms an opening 607 for the hands to fit therein. The body of the housing 605 has an elongated member 609 that prevents the legs and/or other objects to interfere with a sensor 613 disposed within the opening 607 and in fluid communication with the ejector 611.

During use, the user places a hand within opening 607, the sensor 613 detects the hand and thereafter the ejector 611 dispenses sanitizer fluid on the hand form a fluid reservoir carried within the housing 605.

Figure 7:
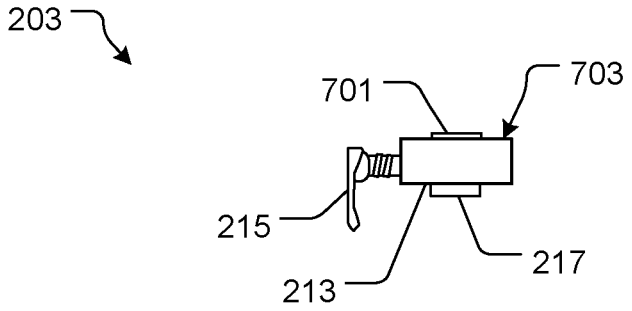
FIG. 7 is a side view of the dispenser.

In FIG. 7, a side view of dispenser 203 in accordance to the preferred embodiment. It will be appreciated that a fastener 701 could be placed on a top surface 703 of the housing 213 and configured to secure the housing 213 to the bottom surface 211 of the table top. In one embodiment, the fastener 701 could be an adhesive; however, alternative embodiments could include hook-loop fasteners, snaps, clips, and/or other suitable devices.

Figure 8:
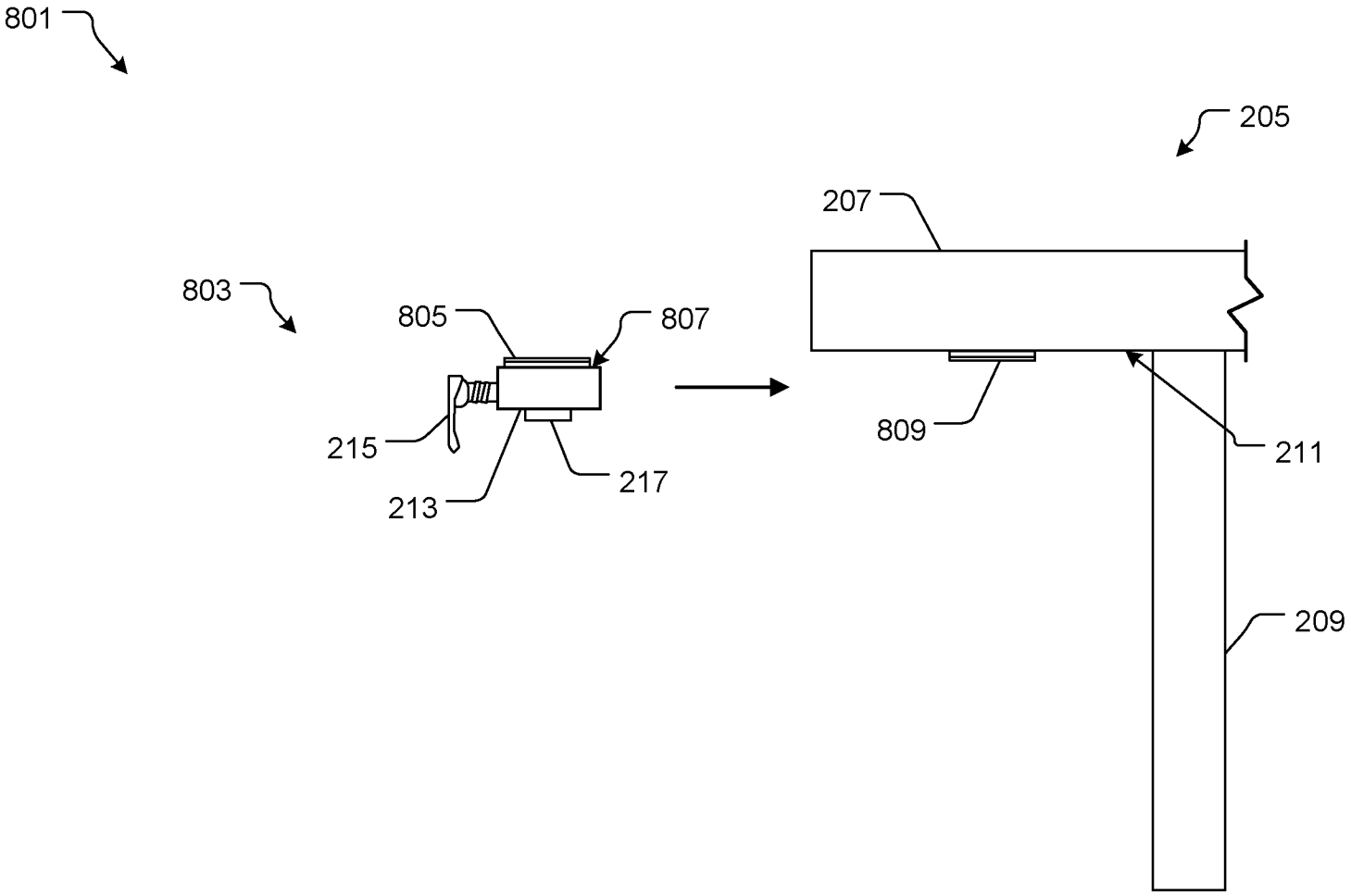
FIG. 8 is a partial side view of a system in accordance with an alternative embodiment of the present application.

Referring now to FIG. 8, a system 801 is shown in accordance with an alternative embodiment of the present application. It will be appreciated that system 601 hereby incorporates one or more of the features of systems 201, 401, 501, 601 and vice-versa. In this embodiment, the system 801 includes a dispenser 803 with a rail 805 secured to surface 807 of the housing 213 and configured to removably engage with a rail 809 secured to surface 211 of the table top 207. Accordingly, this embodiment provides rapid means to remove the dispenser 803 from the table.

Figure 9:
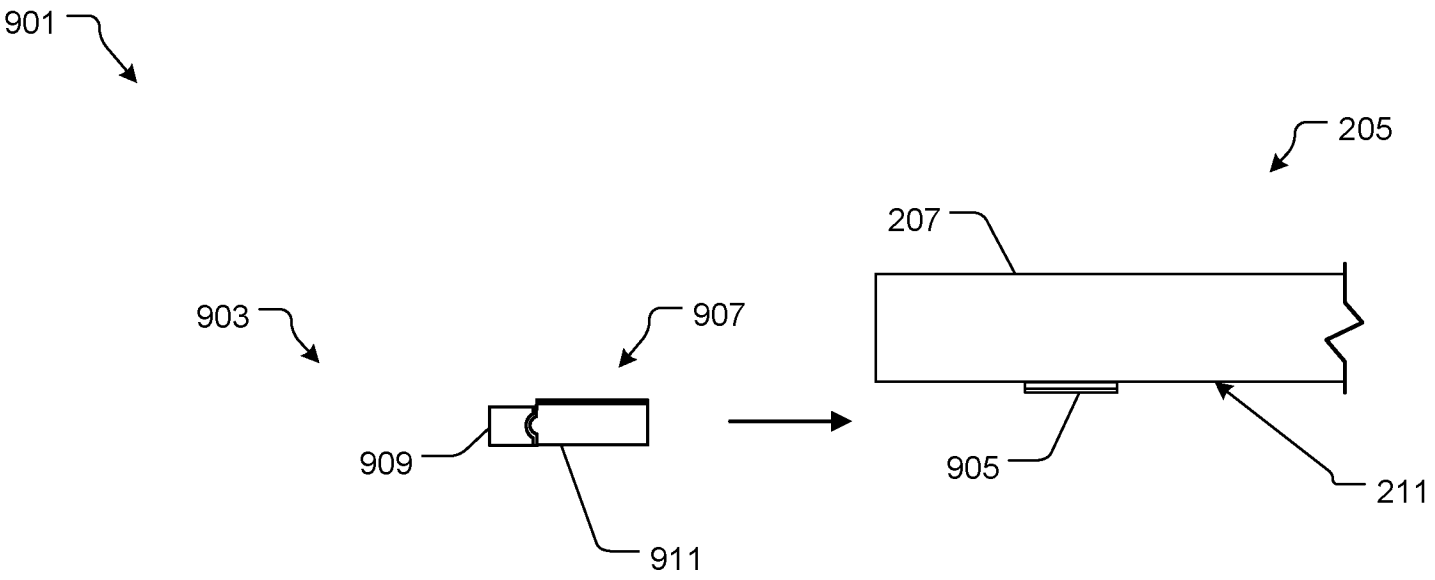
FIG. 9 is a partial side view of an alternative embodiment of a sanitizer system in accordance with the present application.

Referring now to FIG. 9, an alternative embodiment of a dispensing system 901 is shown, having a table 205 with top surface 207 and bottom surface 211. It should be appreciated that alternative embodiments contemplate table 205 being interchanged with a desk or the like. System 901 includes a fluid dispenser 903 having a base 905 secured to surface 211 and configured to slidingly engage with dispenser body 907. In this embodiment, body 907 includes a front portion 909 configured to depress against a back portion 911 to dispense fluid therefrom. The specific features of fluid dispenser 903 are discussed in detail in FIGS. 10-14.

Figure 11:
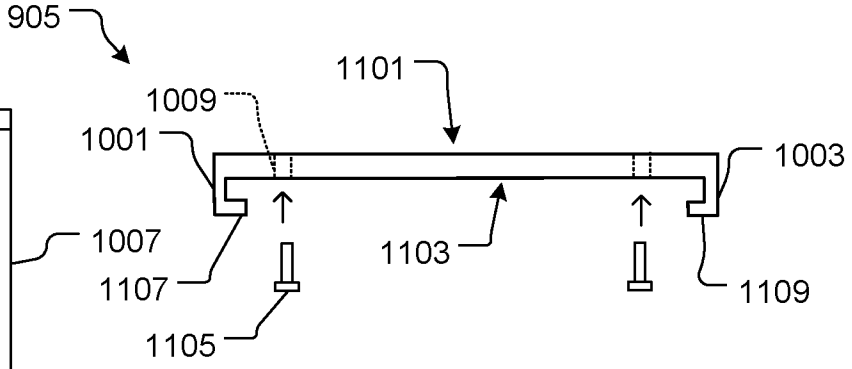
FIG. 11 is an end view of the base of FIG. 10.
Figure 10:
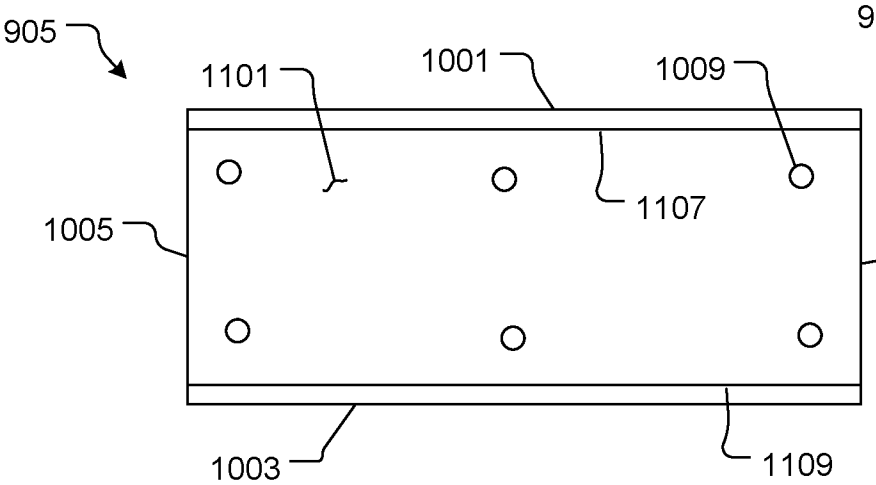
FIG. 10 is a top view of a base of the sanitizer system of FIG. 9.
Figure 13:
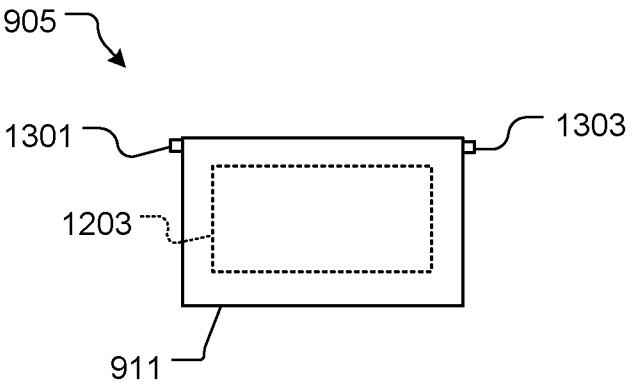
FIG. 13 is an end view of the fluid dispenser body of FIG. 12.

In FIGS. 10 and 11, a top view and an end view of base 905 are shown. Base 905 includes a top surface 1101 and a bottom surface 1103 and extends from a first side 1001 to a second side 1003 and from a front 1005 to a back 1007. The top surface 1101 is configured to secure flat against the bottom surface of the table. Further included are one or more holes 1009 configured to receive one or more fasteners 1105 to secure the base to the table. It should be appreciated that the fasteners can be screws, bolts, or the like. As best shown in the end view of FIG. 11, the base 905 further includes a first and second rail 1107, 1109 that extend inward and underneath of surface 1103. The rails can extend the full length of sides 1003, 1001 or a partial length of the sides.

Figure 12:
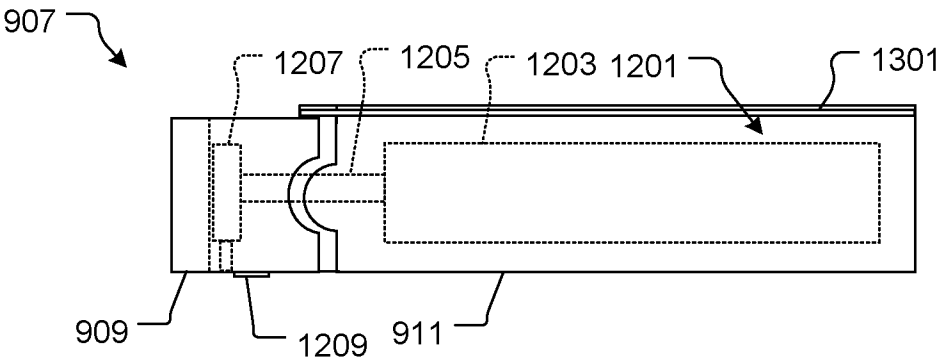
FIG. 12 is a side view of a fluid dispenser body of the sanitizer system of FIG. 9.

In FIG. 12, a side view of the fluid dispenser body 907 is shown, having front portion 909 connected to back portion 911. Body 907 forming an interior area 1201 configured to hold a fluid container 1203 therein, the fluid container 1203 in communication with a pump 1205 and a button 1207, wherein depressing the button 1207 releases fluid from an opening 1209, such that the fluid is dispensed downward. In one embodiment, the front portion 909 is configured to be pressed to engage the button 1207 and thereby release the fluid. As best shown in the end view of FIG. 13, body 907 further includes lips 1301, 1303 that are configured to engage with rails 1107, 1109.

Figure 14A:
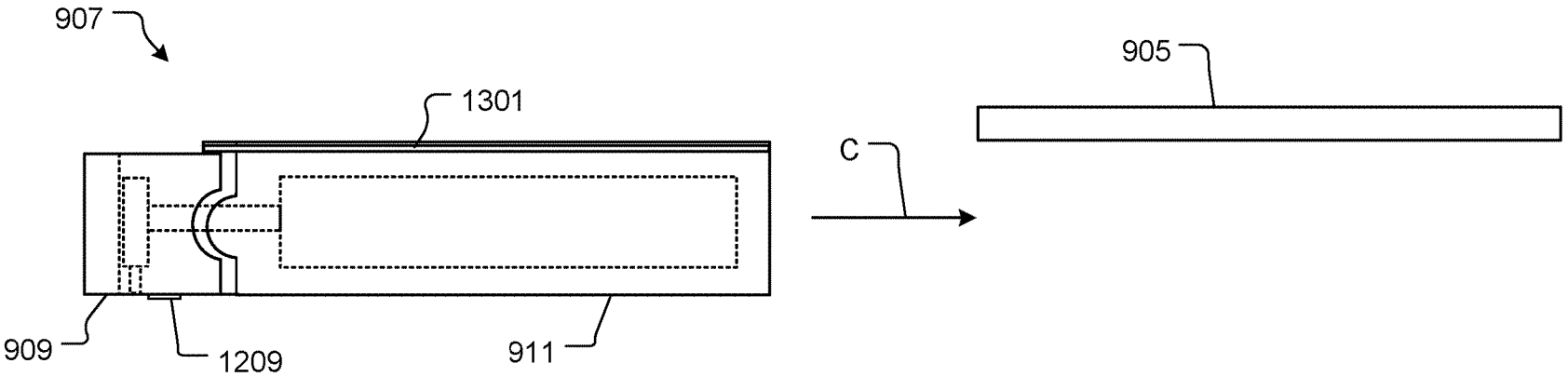
FIG. 14A is a side view depicting a first step of engagement of the fluid dispenser body and the base of the sanitizer system of FIG. 9.
Figure 14B:
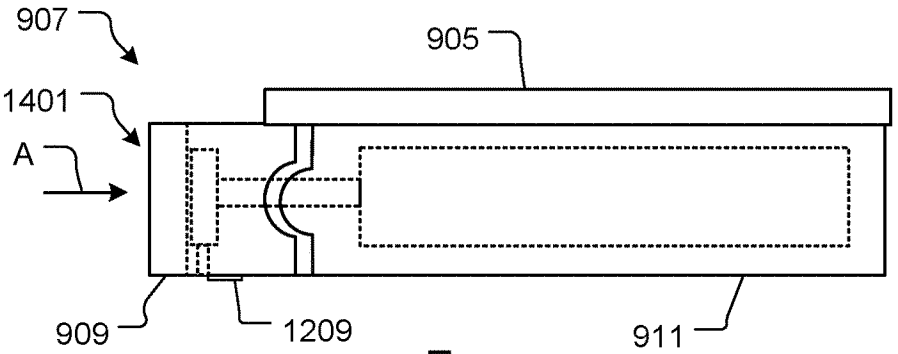
FIG. 14B is a side view depicting a second step of engagement of the fluid dispenser body and the base of the sanitizer system of FIG. 9.
Figure 14C:
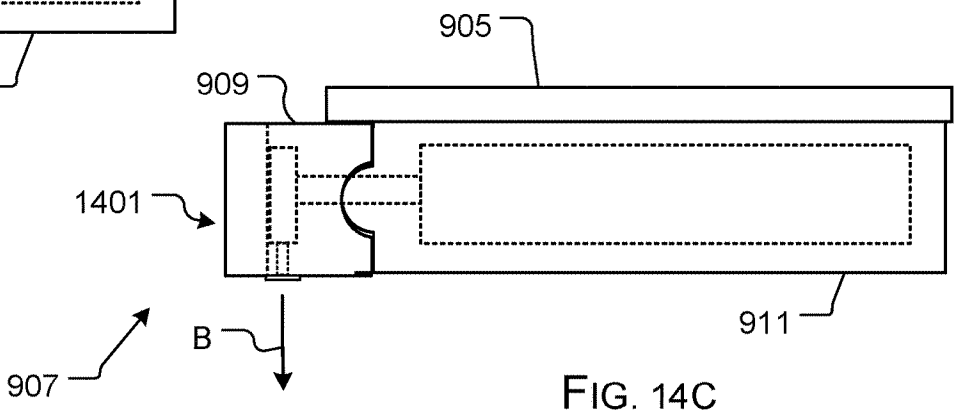
FIG. 14C is a side view depicting a third step of engagement of the fluid dispenser body and the base of the sanitizer system of FIG. 9.

In FIGS. 14A-C, the engagement of body 907 with base 905 is shown. Further shown is the application of pressure (A) to face surface 1401, thereby depressing first portion 909 to back portion 911, thereby causing the release of fluid downward (B) from opening 1209. It should be appreciated that in this embodiment, the base 905 is installed permanently or semi-permanently to the underneath portion of the table, thereby allowing for the body 907 to slidingly engage (C) therewith.

Figure 15:
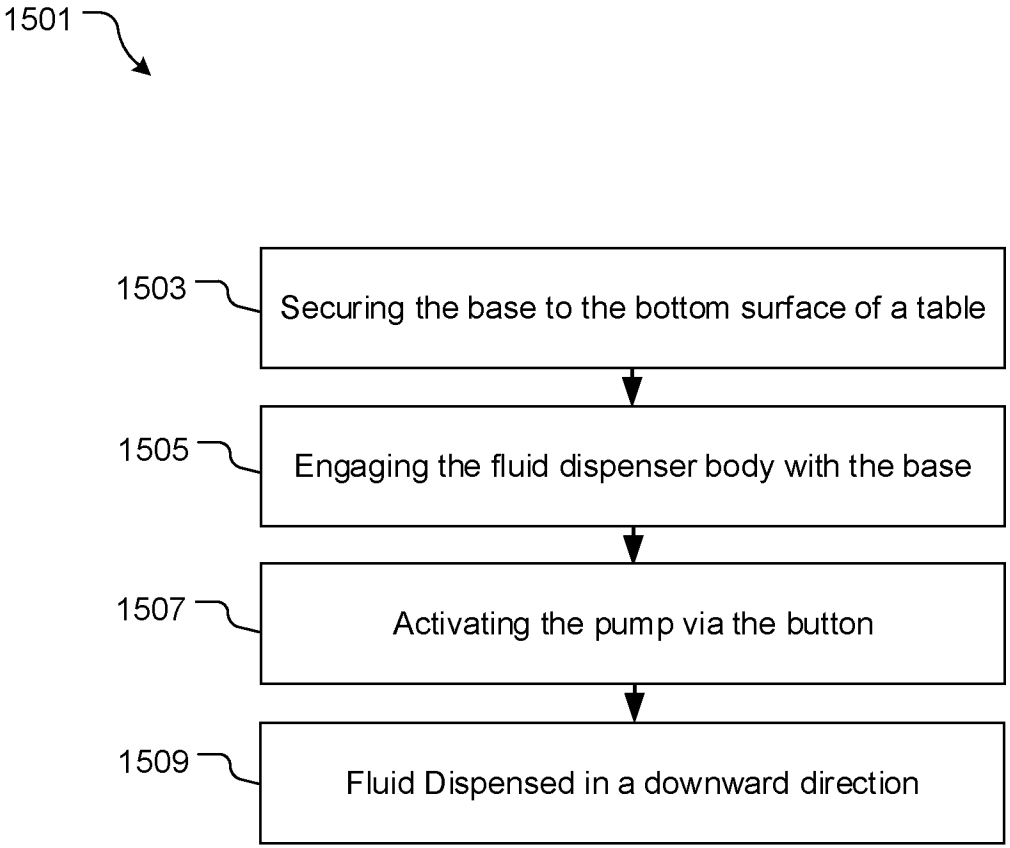
FIG. 15 is a flowchart of the method of use of the sanitizer system of FIG. 9.

In FIG. 15, a flowchart 1501 depicts a method of use of system 901. During use, the base is secured to the bottom surface of the table such that the body can slidingly engage therewith, as shown with boxes 1503, 1505. The pump is activated via depressing the button to dispense fluid from the opening in a downward direction, as shown with boxes 1507, 1509.

It must be understood that the features of the various embodiments discussed herein can be interchanged and used to teach alternative systems.

It is apparent that a system and method of use with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A combination of a fluid dispenser and a table, comprising:

the table having a top surface and a bottom surface;

the fluid dispenser having:

a base with a base top surface and a base bottom surface, the base top surface configured to secure flat against the bottom surface of the table, the base extending from a first side to a second side and from a front side to a back side, the base further having a first rail extending at least a partial length of the first side and a second rail extending at least a partial length of the second side;

a body forming an interior area, the body having a first lip and a second lip, the first lip and second lip to slidingly engage with the first rail and the second rail, thereby securing the base and the body together;

a pump in communication with the interior area;

a button engaged with the pump; and an opening extending into the interior area, the opening configured to release a fluid contained within the interior area upon depressing the button;

wherein the fluid is released in a downward direction away from the bottom surface of the table.

2. The combination of claim 1, wherein the body further comprises a front portion and a back portion, the front portion configured to be depressed against the back portion to activate the button.

3. The combination of claim 1, wherein the first rail extends an entire length of the first side.

4. The combination of claim 1, wherein the base is rectangular.

5. The combination of claim 1, further comprising:

a first securement device configured to be inserted through the base to secure the base to the bottom surface of the table.

6. The combination of claim 1, wherein the first rail extends inward from the first side to a position below the base bottom surface.

7. A method of sanitation, the method comprising:

providing a table having a top surface and a bottom surface;

providing a fluid dispenser having a base with a base top surface and a base bottom surface, the base top surface configured to secure flat against the bottom surface of the table, the base extending from a first side to a second side and from a front side to a back side, the base further having a first rail extending at least a partial length of the first side and a second rail extending at least a partial length of the second side, a body forming an interior area, the body having a first lip and a second lip, the first lip and second lip to slidingly engage with the first rail and the second rail, a pump in communication with the interior area, a button engaged with the pump, and an opening extending into the interior area;

securing the base to the bottom surface of the table such that the base top surface secures flat against the bottom surface of the table;

engaging the body with the base via slidingly engaging the first lip and the second lip with the first rail and the second rail; and depressing the button to dispense fluid from the opening.

* * * * *